US009351560B2

(12) United States Patent
Tussy

(10) Patent No.: US 9,351,560 B2
(45) Date of Patent: May 31, 2016

(54) PLUMBING FIXTURE CLEANING DEVICE

(71) Applicant: Kevin Alan Tussy, Las Vegas, NV (US)

(72) Inventor: Kevin Alan Tussy, Las Vegas, NV (US)

( * ) Notice: Subject to any disclaimer, the term of this patent is extended or adjusted under 35 U.S.C. 154(b) by 106 days.

(21) Appl. No.: 14/195,747

(22) Filed: Mar. 3, 2014

(65) Prior Publication Data

US 2014/0289979 A1 Oct. 2, 2014

Related U.S. Application Data

(60) Provisional application No. 61/771,719, filed on Mar. 1, 2013.

(51) Int. Cl.

| | |
|---|---|
| ***A46B 15/00*** | (2006.01) |
| ***B05B 15/02*** | (2006.01) |
| ***B08B 1/00*** | (2006.01) |
| ***B08B 3/04*** | (2006.01) |
| *B05B 1/18* | (2006.01) |
| *B08B 17/02* | (2006.01) |

(52) U.S. Cl.

CPC ..... *A46B 15/0055* (2013.01); *B05B 15/0208* (2013.01); *B08B 1/002* (2013.01); *B08B 3/04* (2013.01); *B05B 1/18* (2013.01); *B08B 17/025* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,952,860 | A * | 9/1960 | George | 15/29 |
| 4,566,144 | A * | 1/1986 | Arneson | 15/3 |
| 4,813,091 | A * | 3/1989 | Glasener | 15/160 |
| 4,872,235 | A * | 10/1989 | Nielsen | 15/104.92 |
| 5,647,084 | A * | 7/1997 | Still et al. | 15/104.92 |
| 6,264,391 | B1 * | 7/2001 | Kroha | 401/201 |
| 6,430,770 | B1 * | 8/2002 | Glass | 15/104.92 |
| 6,813,798 | B2 * | 11/2004 | Moga | 15/104.93 |
| 7,798,735 | B2 * | 9/2010 | Barker | 401/10 |

* cited by examiner

*Primary Examiner* — David Walczak
(74) *Attorney, Agent, or Firm* — Weide & Miller, Ltd.

(57) ABSTRACT

A cleaning device for cleaning a plumbing fixture with a solution comprises a vessel, bristles at the bottom of the vessel that extend into the vessel, and a retainer configured to retain the vessel in a working position. The retainer may be a drawstring with a stop to secure the drawstring. The retainer may retain the vessel in the working position by sufficiently narrowing the opening defined by the vessel. In use, the vessel surrounds the fixture and the bristles lie adjacent to the fixture. The vessel holds the cleaning solution to thereby at least partially submerge the fixture in the cleaning solution. The bristles may be used to scrub the fixture.

19 Claims, 5 Drawing Sheets

PLUMBING FIXTURE CLEANING DEVICE

RELATED APPLICATION

The present application claims priority to and the benefit of U.S. Provisional Patent Application No. 61/771,719 filed Mar. 1, 2013.

FIELD OF THE INVENTION

The present invention relates generally to cleaning implements and specifically to system for cleaning shower heads and similar plumbing fixtures.

BACKGROUND OF THE INVENTION

Plumbing fixtures, including shower heads, can be difficult to clean. Minerals and other deposits from the water flowing through the fixtures can build up over time, leading to clogged nozzles and other parts. Because the build-up is mineral content, it is very hard and difficult to clean.

Certain environmentally-minded fixtures have exacerbated the problem of clogged nozzles in particular. For example, modern environment friendly shower heads generally employ smaller nozzles in order to deliver sufficient pressure using less water than previously-standard shower heads. Being smaller, these opening tend to clog more easily, requiring more frequent cleaning. Self-cleaning shower heads which rely on heat and water pressure to remove mineral deposits do exist, but these types of fixtures expensive and may require frequent repair.

Prior art methods of cleaning suffer from numerous drawbacks. Some solutions propose mechanically removing the hard water build up the shower head, such as by scrubbing with abrasives pads or sharp edged instruments. Thus typically scratches the fixture or may otherwise harm the fixture. Another prior art method of cleaning is spaying a spray cleaner on the fixture and then attempting to wipe away the deposits. This method results in the cleaning solution dripping of the fixture and the deposits remaining.

In addition, the fixture, such as a shower head assembly, may be removed for cleaning, but this removal requires a wrench, making it labor intensive, and also may result in damage to the shower head, pipes or gasket assemblies. The following method and apparatus overcomes the drawbacks of the prior art.

SUMMARY OF THE INVENTION

To overcome the drawbacks of the prior art and provide additional benefits, a cleaning device for cleaning a plumbing fixture with a solution is disclosed. The device comprises a vessel, bristles extending into the vessel, and a retainer configured to retain the vessel in a working position, wherein the vessel surrounds the fixture and the bristles lie adjacent to the fixture. The vessel defines an opening and is configured to hold the solution. The retainer may retain the vessel in the working position by sufficiently narrowing the opening defined by the vessel.

In one embodiment a cleaning device is provided for for cleaning a plumbing fixture with a cleaning solution. The device includes a vessel having a bottom and at least one side wall. The bottom and the at least one side wall define an opening and the vessel is configured to contain a cleaning solution. The bristles extend upward from the bottom into the vessel. A retainer is configured to retain the vessel on the fixture whereby the fixture is located in the vessel and the vessel surrounds the fixture with the bristles located adjacent one or more nozzles on the fixture.

The vessel bottom and at least one side wall is sized to at least partially immerse the fixture in the solution when the fixture is in the vessel. The vessel may comprise a flexible material. The vessel may include one side wall extending from a circular base.

The side of the vessel may be configured with bristles. The vessel may include includes a base that is substantially circular and the at least one side wall is a continuous side wall extending from the base. The bristles may cover the entire inner surface of the base. The vessel may be is transparent. A valve and tube may be located on or near the base. In one configuration the brush is not connected to the vessel thereby allowing the brush to be removed from the vessel. The bristles may be formed integrally with the vessel. The retainer may comprise a drawstring operably connected to the vessel and a stop to secure the drawstring in relation to the vessel to change the size of the opening.

Also disclosed is a method of cleaning a plumbing fixture comprising providing a cleaning device having a vessel, with bristles at the bottom of the vessel, and a retainer. The method of cleaning includes adding cleaning solution to the vessel and positioning the vessel around the fixture, with the bristles adjacent to the fixture and the fixture at least partially immersed in the solution. The user would then retain the vessel adjacent the fixture using the retainer. This places the fixture in the cleaning solution and the cleaning solution is contained by the vessel. After cleaning the user may remove the device from the fixture after the fixture is clean.

This method may include the step of moving the bristles with respect to the fixture such that the bristles mechanically dislodge debris from the fixture before removing the vessel from the fixture. It is also contemplated that the method may further include the step of leaving the fixture in the vessel to allow the fixture to soak in the cleaning solution.

Also disclosed herein is a shower head cleaning device for cleaning a shower head with a solution. The cleaning device includes a vessel configured to hold the solution such that the vessel has an opening at a top end and a closed bottom end. A brush is provided at a bottom end of the vessel with a plurality of bristles. A retainer is operable to change the size of the opening and secure the vessel around the shower head by sufficiently narrowing the opening.

In one embodiment, the retainer is a drawstring-type closure operably connected to the vessel at the opening defined by the vessel. The brush may be formed integrally with the vessel.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

Various other objects, features and advantages of the present invention will become fully appreciated when considered in conjunction with the accompanying drawings, wherein like reference characters denote the same or similar parts throughout the several views.

DETAILED DESCRIPTION

Figure 1:
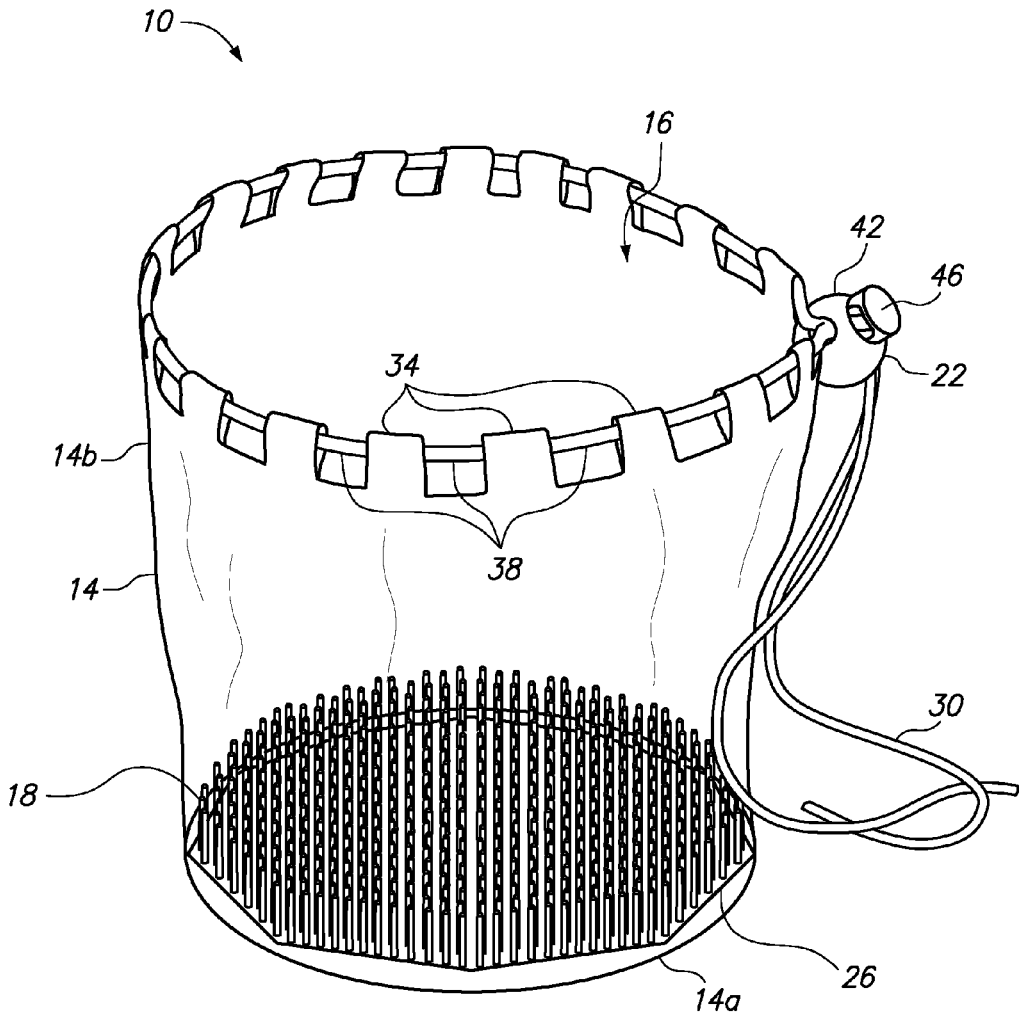
FIG. 1 illustrates a perspective view of a cleaning device according to the present invention.

Referring to the drawings, wherein like reference numbers refer to like components, FIG. 1 shows a cleaning device 10 according to the present invention. The cleaning device 10 includes a vessel 14, bristles 18 extending upward from the bottom into the vessel 14, and a retainer 22. The vessel 14 defines an opening 16 and is configured to receive a cleaning solution suitable for cleaning a given shower head. The opening 16 may be substantially opposite the bristles 18. If mineral removal is the goal of cleaning, an acidic solution such as vinegar or any one of a number of commercially available deposit-removing solutions may be used. The solution may be liquid, or a gel, or a hard substances that molds or forms to the fixture. Water may be added to the vessel to activate or hydrate the cleaning solution. However, any solution may be used within the scope of the invention.

The vessel 14 can be formed from a flexible, water impermeable material such as vinyl or plastic, or may be formed from a more rigid material. The vessel 14 may have one or more walls, or may be irregularly shaped. As shown in FIG. 1, the vessel 14 includes a substantially flat circular base 14*a* with a continuous sidewall 14*b* extending upward therefrom. The periphery of the sidewall 14*b* opposite the base 14*a* defines the opening 16. In other embodiments, the vessel 14 may have a square base with four upwardly extending sidewalls. In still other embodiments, the vessel 14 may be one continuous piece of material having any shape or an irregular shape.

Figure 2:
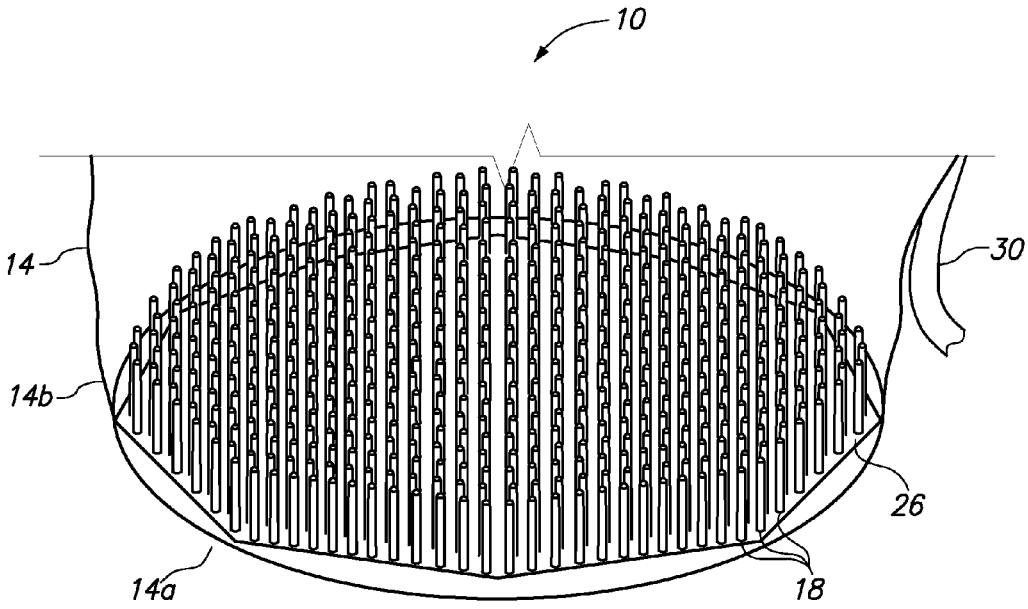
FIG. 2 illustrates a close-up view of the bottom of the cleaning device of FIG. 1.

As shown in FIGS. 1 and 2, bristles 18 extend into the vessel 14. In this embodiment the bristles 18 are clustered together on a brush 26 on the bottom surface of the vessel with the brush 26 attaching to the bottom and/or sides of the vessel 14. If the vessel 14 has a base 14*a*, the brush 26 may attach at the base 14*a* with the bristles pointing upward. The brush 26 may be similarly sized to the base 14*a*, such that affixing the brush 26 to the base 14*a* covers the entire base 14*a* with bristles 18. The brush 26 can affix to the vessel 14 to create a water-tight seal, or liquid may be able to flow freely between some portions of the brush 26 and the vessel 14. The side of the vessel 14 could also be configured with bristles to aid in the cleaning of the side of the plumbing fixture.

Alternatively, the bristles 18 may be formed integrally with the vessel 14. For example, the base 14*a* may comprise a brush 26 having a plurality of bristles 18, with the vessel 14 then comprising the brush 26 and the continuous sidewall 14*b*. In some embodiments, some bristles 18 may be disposed on a brush 26 affixed to the vessel 14, with other bristles 18 formed integrally with the vessel 14.

The bristles 18 are designed to contact and scrub the mineral deposits of the fixture and optionally infiltrate openings within a shower head to assist with mineral deposit removal as described herein. The bristles 18 may be formed from any appropriate material. In one embodiment, the bristles 18 are formed from the same material as the vessel 14. In other embodiments, a semi-rigid plastic, rubber or fiber material may be used, or a combination thereof. Thus, bristles 18 within the same vessel 14 may be made of different materials. The dimensions of the bristles 18 may be influenced by the particular shower head to be cleaned. For instance, low-flow eco-friendly shower heads, having smaller nozzle openings, may best be cleaned with bristles of a smaller diameter, while older standard shower heads may best be cleaned with larger bristles.

Figure 3:
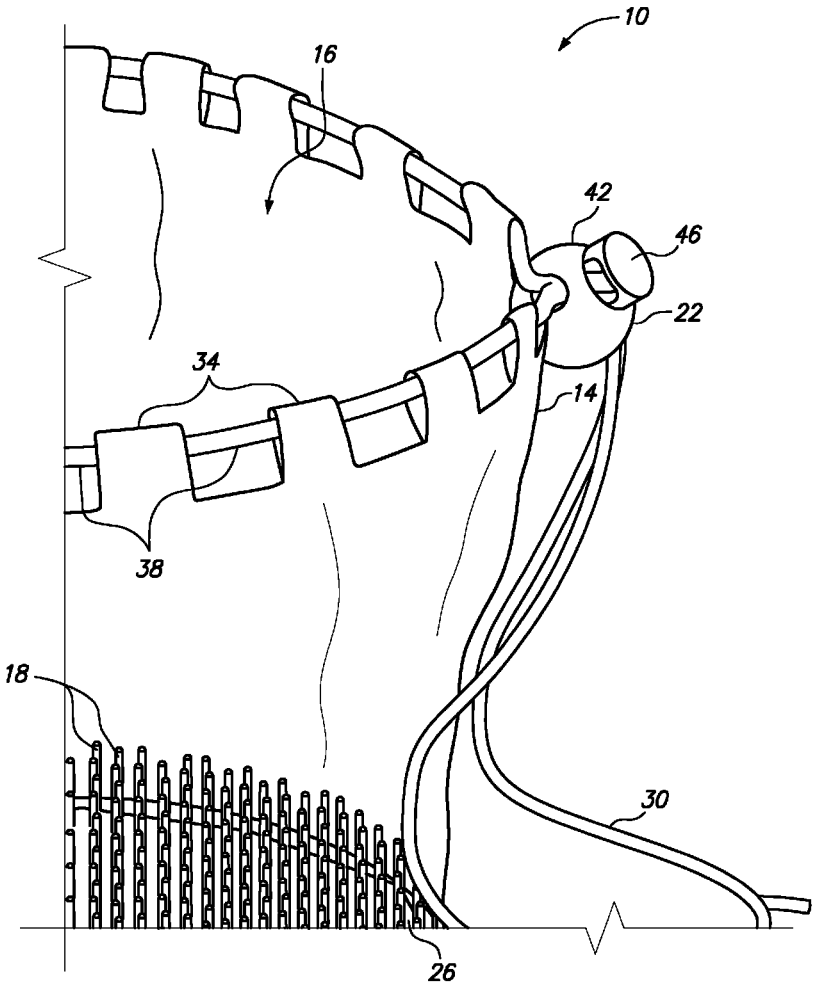
FIG. 3 illustrates a close-up view of the top of the cleaning device of FIG. 1.

FIG. 3 illustrates an enlarged view of the retainer 22. In FIG. 3 similar elements are identified with identical reference numbers. A retainer 22 which is operably connected to the vessel 14 maintains the position of the vessel 14 proximate the fixture, such as the shower head, during cleaning. In use, the opening 16 would be enlarged and the vessel 14 moved upward to cover and enclose the fixture. Then, the retainer 22 is used to reduce the size the opening to less than the size of the fixture. The reduced size of the opening in combination with the retainer 22 prevents the vessel from sliding off of the fixture. As shown in FIGS. 1 and 4, the retainer 22 may be a drawstring-type closure, with a drawstring 30 threading through loops 34 formed around the opening 16. The loops 34 may be made from the same material as a portion of the vessel 14, or may comprise another material. Notches 38, with the material cut away, between the loops 34 allow for easier cinching of the drawstring 30.

The drawstring 30 threads through a stop 42 having a button 46. When the button 46 is depressed, the stop 42 may be moved along the drawstring 30 to either widen or narrow the opening 16. Releasing the button 46 hampers movement of the stop 42 with respect to the drawstring 30, causing the width of the opening 16 to remain relatively constant when the button 46 is disengaged.

While a drawstring-type closure has been described herein, the retainer 22 may comprise any other type of retaining mechanism. For example, the retainer may comprises one or more hooks, straps, constrictors such as rubber bands or other elastic, pull cords, clamps, or any other device or system.

Figure 4A:
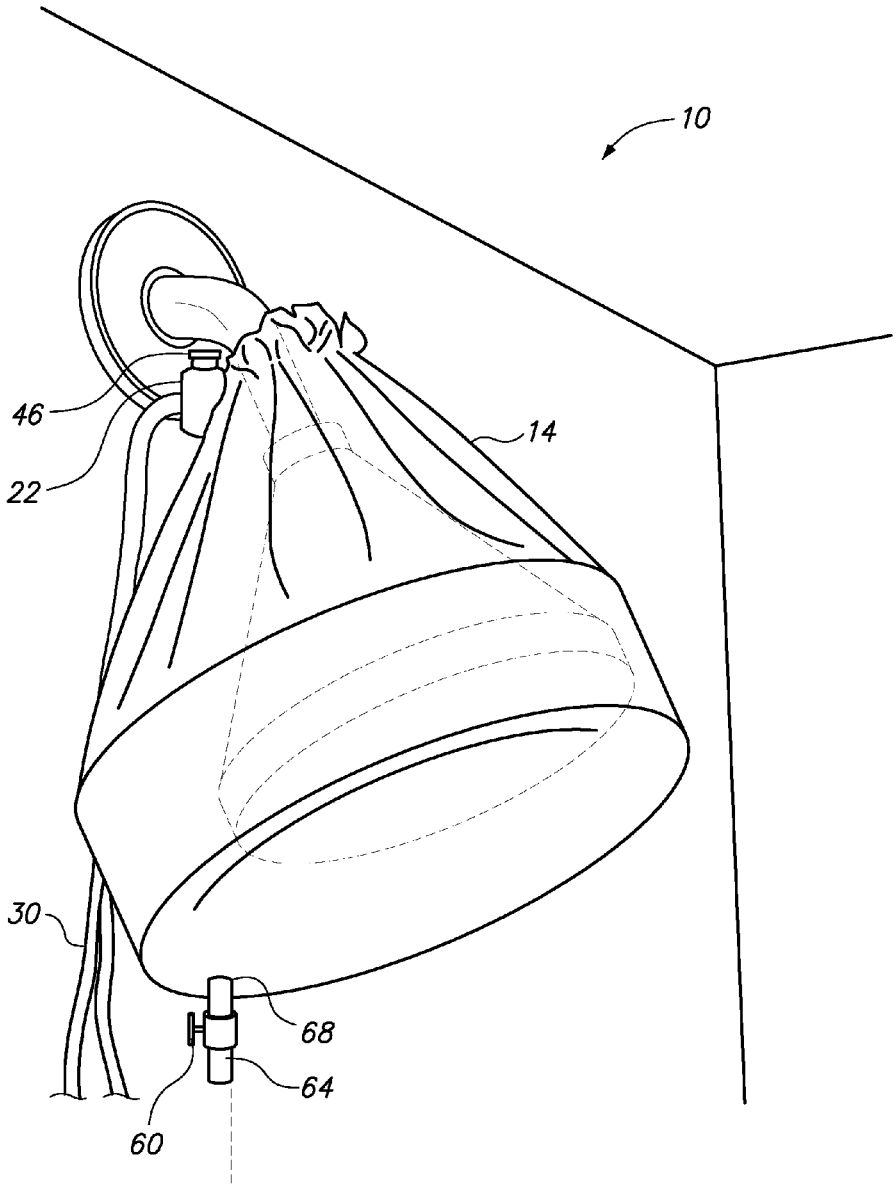
FIGS. 4A and 4B illustrate the cleaning device held in a working position by a retainer with a valve and side bristles.
Figure 4B:
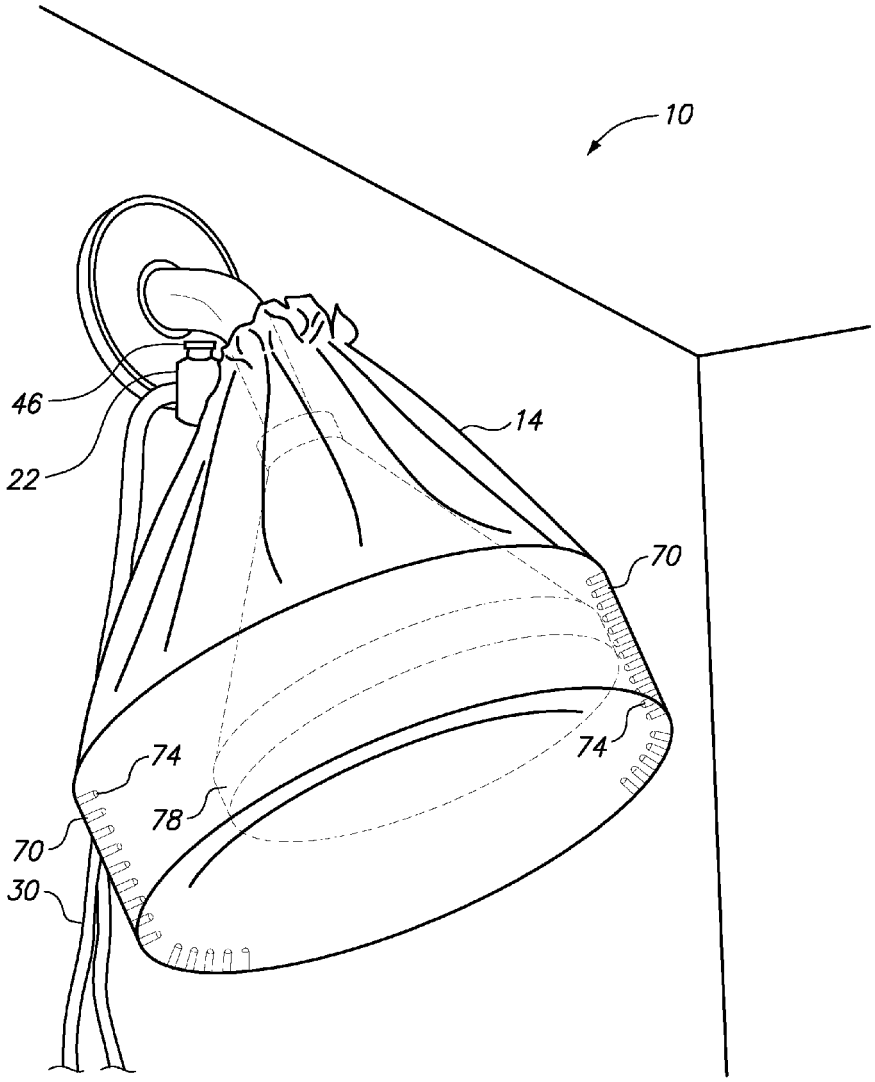

FIGS. 4A and 4B illustrates the cleaning device 10 in a working position when secured to a plumbing fixture. FIGS. 4A and 4B are discussed in connection with the other Figures. In this example environment of use the fixture is a shower head, but in other embodiments, the fixture may be any plumbing fixture that accumulates water deposits. In the working position, the vessel 14 surrounds the shower head and the bristles 18 rest adjacent to a portion of the shower head with water nozzle openings. To reach the working position, the button 46 on the stop 42 is depressed, allowing the stop 42 to be pushed up the drawstring 30 toward the vessel 14 while the drawstring 30 is held taut, thus narrowing the opening 16 by cinching the material at the opening 16. The opening 16 encircles a portion of the shower head assembly itself, or a portion of a supply pipe feeding the shower head assembly. The supply pipe has a smaller diameter than the shower head. In embodiments in which the supply pipe does not have a diameter that is more narrow than the fixture, other vessel securing methods may be used.

The button 46 on the stop 42 is released when the opening 16 is narrow enough to prevent the vessel 14 from sliding off of the shower head assembly during use, and also narrow enough to maintain the position of the bristles 18 with respect to the shower head (i.e., if the opening 16 is too wide, even if the vessel 14 cannot fall off of the shower head, the bristles 18 may not be adjacent to the shower head). In such a manner, the retainer 22 retains the vessel 14 in the working position.

In practice, a user adds solution to the vessel 14 and then positions the vessel 14 around the shower head or other plumbing fixture to be cleaned with the bristles 18 adjacent to the shower head nozzles. Sufficient solution may be provided so that the shower head at least partially submerged in the solution. The solution may be added to the vessel either prior to or after placing the vessel on the fixture.

The retainer 22 is then used to retain the vessel 14 in the working position. Specifically, the drawstring 30 is cinched, narrowing the opening 16 around the supply pipe. The user may optionally scrub the shower head using the bristles 18 by applying pressure to the vessel 14 at the brush 26. In this manner, the brush 26 and associated bristles 18 not shown in FIG. 4B) are able to mechanically dislodge mineral deposits inside the shower head nozzles while the solution operates to dissolve the deposits. If brush bristles 74 are presented on the side 70 of the vessel 14, the vessel may be twisted slightly side to side to scrub the side 78 of the fixture. The user may soak the shower head or other fixture for any appropriate amount of time before scrubbing the shower head with the bristles 18, or may choose not to scrub the shower head manually at all. In this method of use, the solution would simply dissolve the deposits.

It should be appreciated that different shapes and sizes of vessels 14 and bristles 18 may be used to accommodate various sizes of shower heads. Additionally, the device according to the invention can be used to clean other plumbing fixtures, such as faucet spouts. In this case, the vessel 14 and the accompanying bristles 18 would likely be much smaller than those utilized to clean a shower head.

In one alternative embodiment with a valve as shown in FIG. 4A, the bottom of the vessel is provided with a valve 60 and a tube 64 that may extend downward to the bottom of the bathtub, shower, or sink. When the fixture is clean, the valve may be opened thereby allowing the cleaning solution to drain from an opening 68 in or near the bottom of the vessel, through the tub, and into the drain of the bathtub, shower, or sink.

It is also contemplated that the vessel may be equipped with a funnel or bottle of cleaning solution such that to fill the vessel with cleaning solution, a valve could be opened to allow the cleaning solution to drain from the bottle directly into the vessel. This would prevent spilling of the cleaning solution. In one embodiment, the cleaning solution may be contained in a separate compartment within the vessel and that compartment broken after the vessel is installed on the fixture. This releases the cleaning solution only after the vessel is in place.

The vessel may be clear to allow the user to see through the vessel to determine if the fixture is clean without having to remove the fixture. Instructions may be printed on the vessel.

It is also contemplated that the vessel may also contain a securing device that secures the vessel to the fixture or the supply pipe. As a result, the cleaning device would have both a retainer and a securing device. The retainer may be used to close the opening to retain the cleaning solution, while the securing device is used to secure the cleaning device to the fixture. The securing device may comprise any element such as something similar to the retainer, including hooks, straps, tape, adhesive or any other element.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

While the various modes for carrying out the invention have been described in detail, it is to be understood that the terminology used is intended to be in the nature of words and description rather than of limitation. Those familiar with the art to which this invention relates will recognize that many modifications of the present invention are possible in light of the above teachings. It is therefore to be understood that within the scope of the appended claims, the invention may be practiced in a substantially equivalent way other than as specifically described herein.

What is claimed is:

1. A cleaning device for cleaning a plumbing fixture with a cleaning solution comprising:

a vessel having a bottom and at least one side wall, the bottom and the at least one side wall defining an opening, the vessel formed from a transparent material and also configured to and capable of containing within the vessel a liquid cleaning solution;

bristles extending upward from the bottom into the vessel; and a retainer configured as a drawstring, hook, or one or more straps to engage and retain the vessel around the fixture whereby during use the fixture is located in the vessel and the vessel surrounds the fixture with the bristles located adjacent one or more nozzles on the fixture.

2. The device of claim 1, wherein the vessel bottom and at least one side wall is sized to at least partially immerse the fixture in the solution when the fixture is in the vessel.

3. The device of claim 1, wherein the vessel comprises a flexible material.

4. The device of claim 1, wherein the vessel includes one side wall extending from a circular base.

5. The device of claim 1, wherein the side of the vessel is configured with bristles.

6. The device of claim 1, wherein the vessel includes a base that is substantially circular and the at least one side wall being a continuous side wall extending from the base.

7. The device of claim 1, wherein the bristles cover an entire inner surface of the bottom.

8. The device of claim 1, further comprising a valve located on or near the bottom, the valve in fluid communication with the liquid cleaning solution and configured to change from a closed position to an open position to drain the liquid cleaning solution from the vessel when the vessel is retained on the plumbing fixture.

9. The device of claim 1, wherein the brush is not connected to the vessel thereby allowing the brush to be removed from the vessel.

10. The device of claim 1, wherein the bristles are formed integrally with the vessel.

11. The device of claim 1, wherein the retainer comprises a drawstring operably connected to the vessel and a stop to secure the drawstring in relation to the vessel to change the size of the opening.

12. A method of cleaning a plumbing fixture using a cleaning device comprising:

providing the cleaning device, the cleaning device including a vessel configured to contain a liquid such that vessel include a bottom, one or more sides, and an open top, bristles extending upward from the bottom of the vessel and, a retainer configured to retain the cleaning device to the plumbing fixture;

adding a cleaning solution to the vessel such that the cleaning solution covers the bristles;

positioning the vessel around the fixture such that the fixture is within the vessel with the top of the bristles are adjacent to a bottom portion of the fixture and the fixture is at least partially immersed in the solution;

hanging the device from the fixture or a pipe connected to the fixture such that the fixture or the pipe supports the device; and removing the device from the fixture after the fixture is clean.

13. The method of claim 12 further including the step of moving the bristles with respect to the fixture after the fixtures are positioned in the vessel such that the bristles mechanically dislodge debris from the fixture before removing the vessel from the fixture.

14. The method of claim 12 further including the step of leaving the fixture in the vessel to cause the fixture to soak in the cleaning solution.

15. A shower head cleaning device for cleaning a shower head with a liquid solution comprising:

a vessel configured to and capable of holding the liquid solution, the vessel having an opening at a top end defined by one or more side walls and a closed bottom end;

a brush within the vessel at the closed bottom end, the brush having a plurality of bristles extending upward into the vessel from the bottom;

a retainer including one or more hooks, straps, constrictors, rubber bands, elastic, pull cords, or clamps, the retainer configured to and operable to secure the vessel around the shower head; and a valve located on or near the bottom, the valve in fluid communication with the liquid cleaning solution and configured to change from a closed position to an open position to drain the liquid cleaning solution from the vessel when the vessel is retained on the fixture.

16. The device of claim 15, wherein the retainer is a drawstring-type closure operably connected to the vessel at the opening defined by the vessel by narrowing the opening to have a diameter that is less than a diameter of the shower head.

17. The device of claim 15, wherein the brush is formed integrally with the vessel.

18. A cleaning device for cleaning a plumbing fixture with a cleaning solution comprising:

a vessel having a bottom and at least one side wall, the bottom and the at least one side wall defining an opening, the vessel configured to and capable of containing a cleaning solution;

bristles extending upward from the bottom into the vessel;

a retainer configured as a drawstring, hook, or one or more straps to engage and retain the vessel around the fixture whereby during use the fixture is located in the vessel and the vessel surrounds the fixture with the bristles located adjacent one or more nozzles on the fixture; and a valve located on or near the bottom of the vessel, the valve in fluid communication with the cleaning solution and configured to change from a closed position to an open position to drain the cleaning solution from the vessel when the vessel is retained on the fixture.

19. A shower head cleaning device for cleaning a shower head with a solution comprising:

a transparent vessel configured to and capable of holding the solution, the vessel having an opening at a top end defined by one or more side walls and a closed bottom end;

a brush within the vessel at the closed bottom end, the brush having a plurality of bristles extending upward into the vessel from the bottom;

a retainer including one or more hooks, straps, constrictors, rubber bands, elastic, pull cords, or clamps, the retainer configured to and operable to secure the vessel around the shower head.

* * * * *